US007544135B1

(12) United States Patent
Higgins

(10) Patent No.: US 7,544,135 B1
(45) Date of Patent: Jun. 9, 2009

(54) GOLF SWING ADJUSTABLE TRAINING AID AND METHOD

(76) Inventor: Neil Higgins, 2109 Cypress St., San Luis Obispo, CA (US) 93401

( * ) Notice: Subject to any disclaimer, the term of this patent is extended or adjusted under 35 U.S.C. 154(b) by 81 days.

(21) Appl. No.: 11/746,805

(22) Filed: May 10, 2007

(51) Int. Cl.
*A63B 69/36* (2006.01)

(52) U.S. Cl. ..... 473/294; 473/219; 473/299

(58) Field of Classification Search ..... 473/294, 473/297, 298, 299, 526, 549, 551, 201, 206, 473/219, 226, 282, 296, 552
See application file for complete search history.

(56) References Cited

U.S. PATENT DOCUMENTS 1,919,221 A * 7/1933 Janes ..... 473/294
2,325,525 A * 7/1943 Lukenbill ..... 473/201
5,037,103 A * 8/1991 Williams et al. ..... 473/294
5,388,834 A 2/1995 Dawson
5,401,022 A * 3/1995 McCready ..... 473/294
5,669,823 A * 9/1997 McCready ..... 473/294

* cited by examiner

*Primary Examiner*—Nini Legesse
(74) *Attorney, Agent, or Firm*—William Keyworth; Bill & Mary Lou Inc.

(57) ABSTRACT

A golf swing quick adjustment training aid and method of use is used to teach a golfer the proper body position and swing when putting a ball. The training aid has a frame that is attached to the golfer's putter club. Two adjustable golf club grip handles are removably attached to the frame at adjustable positions in the same plane as the grip of the putter club. The handles may be adjusted to differing symmetrical distances from the putter club grip. Starting at the outermost position from the putter club grip, the golfer practices putting until the golfer is proficient in controlling the speed and direction of the ball. The handles are then adjusted nearer to the putter club grip and the process repeated, then the handles are again adjusted nearer to the putter club grip. This training is continued until the golfer becomes proficient in controlling the speed and direction of the ball with the handles at the innermost position. Then the golfer is ready to use the putter club grip to putt the ball. The golf swing quick adjustment training aid is used in this manner until the golfer becomes proficient in controlling the speed and direction of the ball using the putter club grip.

11 Claims, 8 Drawing Sheets

GOLF SWING ADJUSTABLE TRAINING AID AND METHOD

CROSS-REFERENCE TO RELATED APPLICATIONS

Not Applicable.

STATEMENT REGARDING FEDERALLY SPONSORED RESEARCH AND DEVELOPMENT

Not Applicable.

BACKGROUND OF THE INVENTION

1. Field of the Invention

This application relates to a device for training a golfer to improve the swing of a golf club and a method of use of the device.

2. Description of Related Art

Training aids for golfers to improve their swing are used to impart a sense of proper body and arm position and grip. One such aid for use with a variety of golf clubs is in U.S. Pat. No. 5,388,834 (Dawson). This aid provides a crossbar that clamps to the golfer's club handle, and has two grips at a fixed distance on either side of the clamped club handle. This assists in training the golfer in positioning the hands during the swing and in positioning the body during the swing.

SUMMARY OF THE INVENTION

In the use of a training aid for putting the ball, it is desirable to have aids with handles at differing distances from an attached putter club to teach body position and motion when swinging a golf putter club. Varying the distance of the handles of the aid from the grip of an attached putter as the golfer becomes more proficient in the putting stroke enables the golfer to first learn the proper body position and motion and then practice retaining that position and motion as the handles are moved toward the putter. The golf swing adjustable training aid device provides a body motion and grip training device that allows use of one aid throughout a golfer's training, and use of the device by multiple golfers at differing stages of training.

The golf swing adjustable training aid has a substantially rigid frame with the rectangular-shaped sides forming a top edge, a bottom edge, a left edge and a right edge. One side of the frame has a centrally located golf club rest where a golf club shaft is positioned with the golf club grip above the frame top edge and the golf club shaft below the frame bottom edge. A threaded opening is provided near the rest to allow a golf club clamp to be positioned on top of the golf club shaft and the golf club shaft is retained on the frame by a clamp knob and a fastener engaging the threaded opening by turning the clamp knob, thus engaging the golf club shaft between the golf club rest and the clamp. This provides a means for removably attaching a golf club. A resilient insert may be used between the golf club shaft and the golf club rest to provide an even clamping force along the length of the shaft engaged by the insert.

This side of the frame also has multiple alignment protrusions, including multiple handle attachment alignment channels and multiple handle alignment guides raised above the surface, in multiple locations symmetrically on each side of the golf club rest. Adjacent to the alignment channels and guides are a multiplicity of insert openings arranged partially through the frame into which a multiplicity of magnetic inserts are installed.

There are two adjustable handles. These have a grip end and an attachment end with an attachment opening in the end. The attachment end is inserted into an attachment fixture that provides a means to removably attach to the frame. The fixture has two sides. One side has a handle guide opening and a handle opening insert into which the attachment end of the handle is inserted and the fixture handle opening insert is pressed into the handle opening so the attachment fixture is removably attached to the handle attachment end by the press fit of the opening insert and by encasing the handle by the guide opening. The fixture other side edges are sized to mate with the frame handle attachment alignment channels by fitting between the channels, and also has alignment openings sized to mate with the frame alignment guides by allowing insertion of the guides into the openings. These alignment protrusions, sized to fit the attachment fixture, provide means for positioning the handles in multiple locations and align the handles in the same direction and plane as the golf club grip in each location. This side also has attachment openings with a magnetic insert retained in the opening. These are located to magnetically engage the magnetic inserts in the frame insert openings so the handles are removably engaged with the frame. This engagement allows the golfer to use the two handles to swing the putter.

The putter is installed on the frame with the grip substantially the same height from the frame as the handles. The handles are initially engaged on the frame at the outermost distance from the putter grip. This outermost distance is used for initial training to teach the golfer to properly position the shoulders so as to properly position the putter head at the point of striking the ball. As the golfer practices and accuracy in controlling the speed and direction of the ball improves, the distance of the handles from the clamped putter can be moved to intermediate locations closer to the putter grip and practice continued. This process is continued until the golfer is ready to position the handles at the innermost location, very close to the putter grip. Once the golfer is proficient in controlling the speed and direction of the ball with the handles at the innermost location the golfer is ready to putt without the training aid. Initially this is done by using the aid with the handles at the innermost distance from the putter grip.

OBJECTS AND ADVANTAGES

One object of the present invention is to provide a golf swing training aid device that allows an adjustment of the position of the golfer's hands on the aid as the golfer improves in controlling ball speed and direction.

A second object of the present invention is to provide a golf swing training aid device that may be easily adjustable to allow use by multiple golfers of differing abilities.

A third object of the present invention is to provide a golf swing training aid device that is easily transportable.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
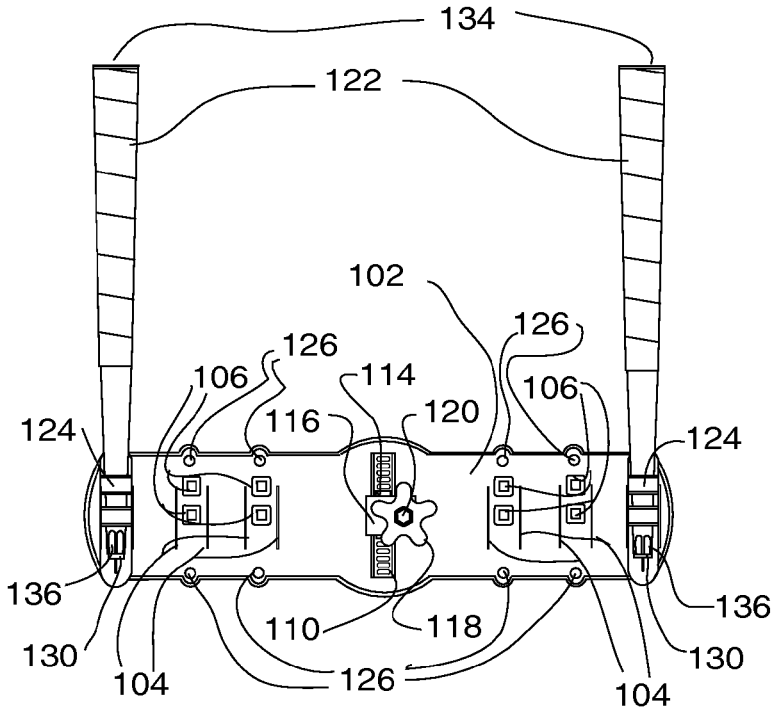
FIG. 1 is a back view of the golf swing adjustable training aid.
Figure 3:
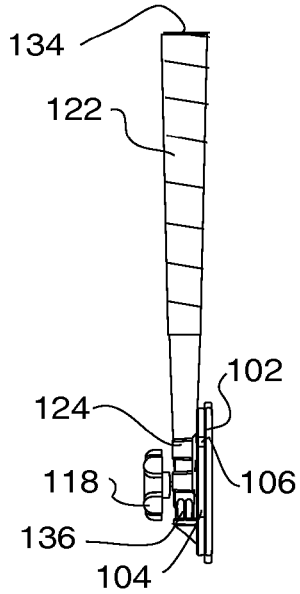
FIG. 3 is a side view of the golf swing adjustable training aid.
Figure 2:
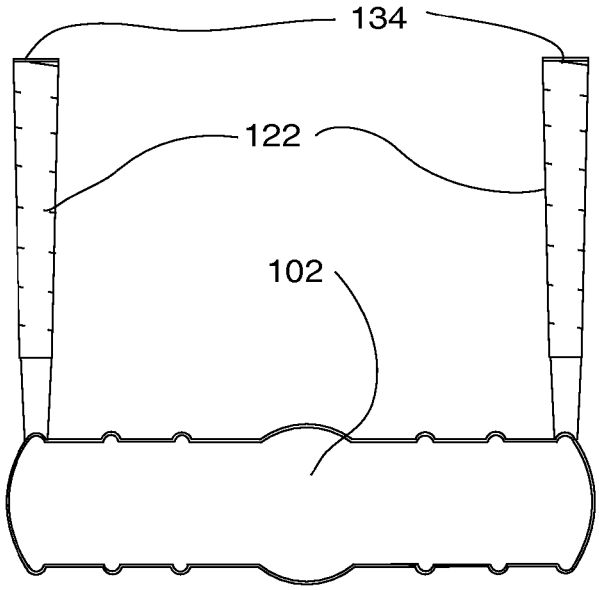
FIG. 2 is a front view of the golf swing adjustable training aid.

These reference numbers are used in the drawings to refer to areas or features of the invention.

102 Frame
104 Handle Attachment Alignment Channel
106 Handle Alignment Guide
108 Insert Opening
110 Golf Club Rest
112 Threaded Opening
114 Resilient Insert
116 Golf Club Clamp
118 Clamp Knob
120 Clamp Fastener
122 Adjustable Golf Club Grip Handle
124 Handle Attachment Fixture
126 Magnetic Insert
128 Fixture Guide Opening
130 Handle Opening Insert
132 Handle Alignment Opening
134 Grip End
136 Attachment End
140 Putter
142 Putter Grip
144 Putter Shaft
146 Putter Head

DETAILED DESCRIPTION OF THE INVENTION

Figure 4:
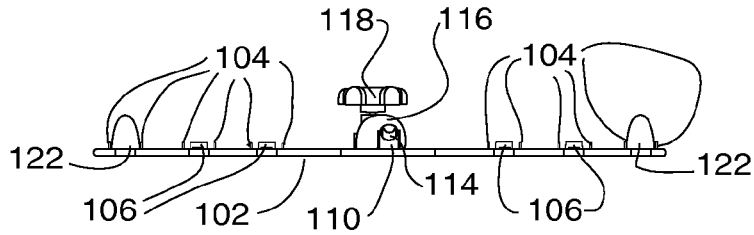
FIG. 4 is a top view of the golf swing adjustable training aid.
Figure 5:
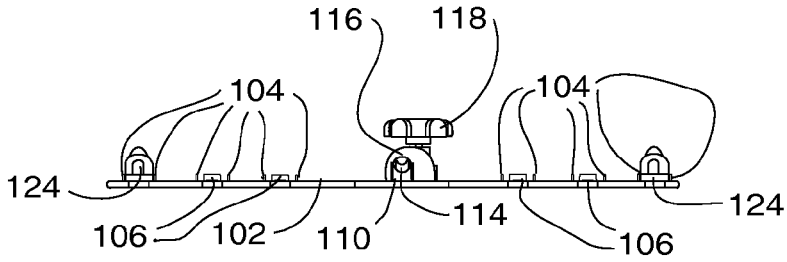
FIG. 5 is a bottom view of the golf swing adjustable training aid.
Figure 6:
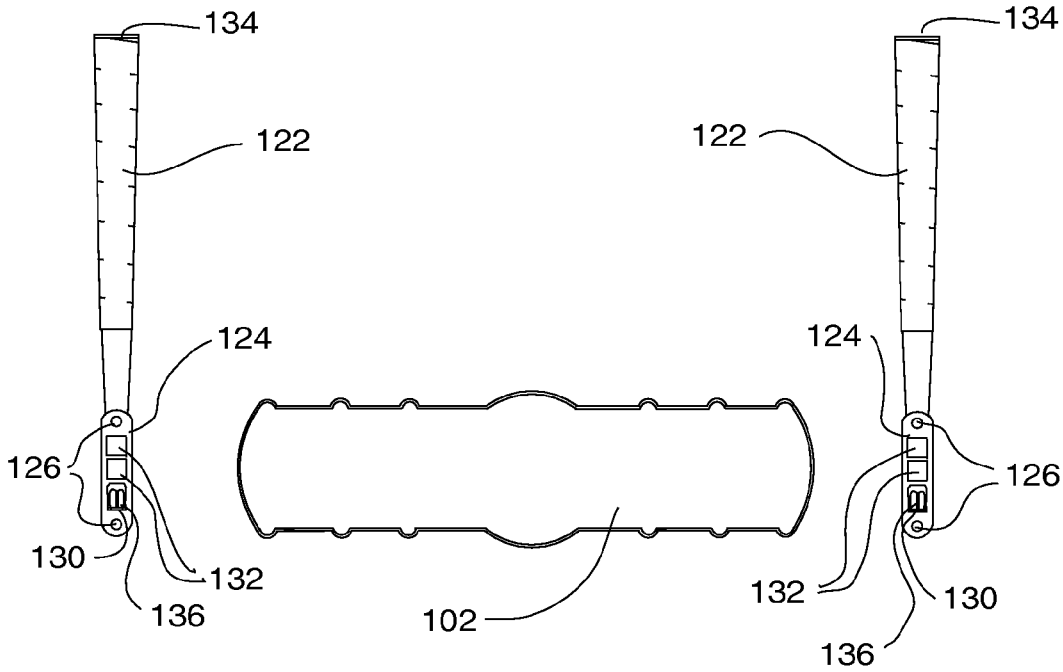
FIG. 6 is a front view of the golf swing adjustable training aid with the adjustable grips released and separated from the body.
Figure 7:
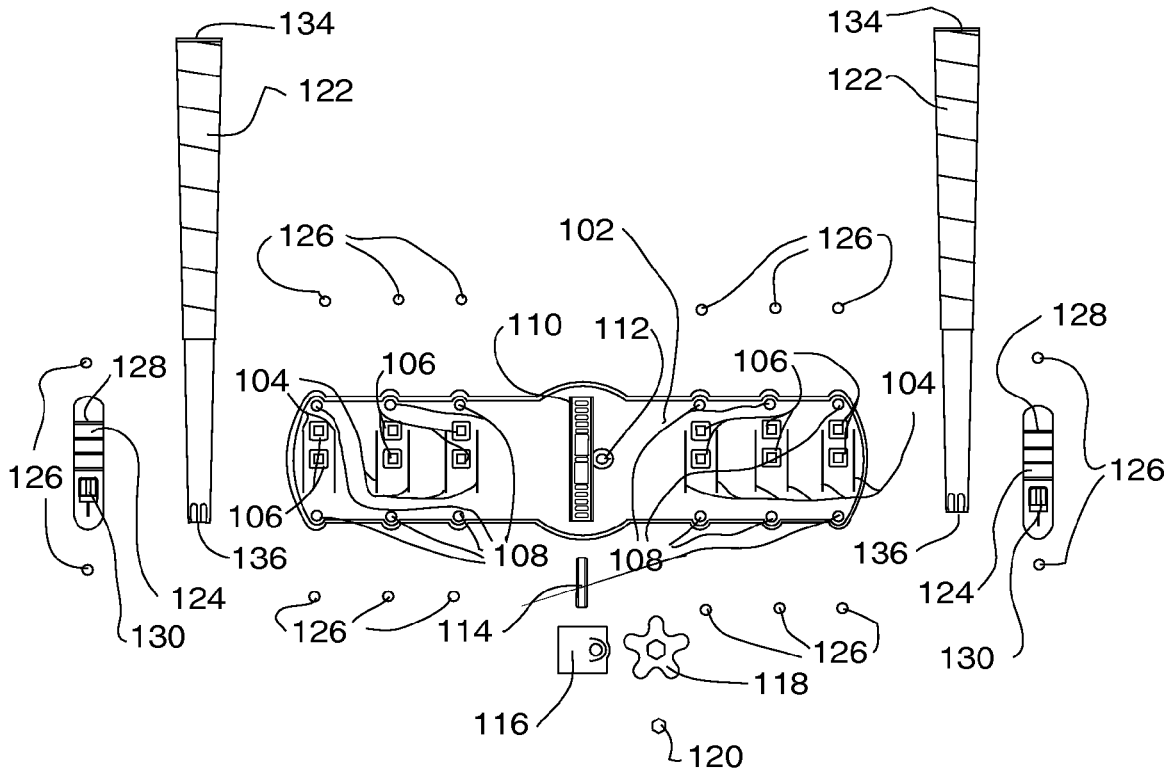
FIG. 7 is an exploded view of the golf swing adjustable training aid showing the parts.

The golf swing adjustable training aid is shown in FIGS. 1-5 with the handles attached in the outermost position, in FIG. 6 with the handles detached, and in an exploded view to show the parts and features in FIG. 7. The device has a substantially rigid frame (102) and two handles (122) that are attached to handle attachment fixtures (124) to attach the handles to the frame.

The second side of the frame, where the handles attach, is shown in FIGS. 1, 3, 4, and 5. This side has handle attachment alignment channels (104) and handle alignment guides (106) protruding from the frame (102) surface. These are located at six locations on the frame, but offset from a central location as shown in FIGS. 4, 5, and 7. Centrally located on the frame (102) surface is a golf club rest (110). The locations of the handle attachment alignment channels (104) and handle alignment guides (106) are selected to be symmetrical with the location of the golf club rest (110), with three locations on each side of the rest. The rest shown in FIGS. 1, 4, 5, and 7 includes provision for installation of a resilient insert (114). Multiple insert openings (108) partially penetrate the surface of this side. These are in rows near the top edge and bottom edge of the frame, as shown in FIGS. 1 and 7, and they contain magnetic inserts (126). The frame (102) is a single piece of molded thermoplastic or thermosetting polymer with the alignment protrusions (104 and 106) and golf club rest (110) included in the mold.

The handles (122) have a resilient golf club grip at the grip end (134) that extends almost to the attachment end (136). This simulates the grip on many golf clubs. The metal handle (122) is exposed the length needed to install it in the handle attachment fixture (124) at the attachment end (136). This portion of the handle (122) is round in shape as compared with the grip end having a flattened side as shown in FIG. 4. The attachment end (136) has an opening. The embodiment shown in FIGS. 1, 3, 6, and 10 have the attachment end crimped in a corrugated shape.

The adjustable golf club grip handles (122) are installed in the handle attachment fixtures (124). On one side of the fixture is a guide opening (128) at the top that is shaped and sized to fit the handle attachment end. The embodiment shown in FIGS. 1, 3, 5, 6, and 10 has the guide opening (128) in two portions of the fixture leaving the handle attachment end (136) exposed between them. The corrugated shape opening in the attachment end (136) is arranged to press onto the handle opening insert (130) near the bottom portion of the attachment fixture (124). The attachment fixture is sized so when the handle is inserted into the guide opening (128) and pressed on the handle opening insert (130) it is removably attached to the fixture such that there is no relative motion between the two parts. The other side of the handle attachment fixture (124) has handle alignment openings (132) that are shaped and sized to mate with the handle alignment guides (106) in the frame (102). The edges of this side of the handle attachment fixture (124) are sized and shaped to mate with the handle attachment alignment channels (104) in the frame (102). This side also has magnetic inserts (126) installed in openings on the surface. These magnetic inserts are located so as to magnetically attach to the magnetic inserts (126) in the frame (102). These locations are arranged relative to the edges of the handle attachment fixture (124) and the handle alignment openings (132) so when the edges and openings are mated with the handle attachment alignment channels (104) and the handle alignment guides (106) in the frame (102) the adjustable golf club grip handle (122), attached to the handle attachment fixtures (124), is properly aligned on the frame and is removably attached to the frame (102) by the magnetic inserts (106) in each part. The handle attachment fixtures (124) are made of a single piece of molded thermoplastic or thermosetting polymer.

Figure 8:
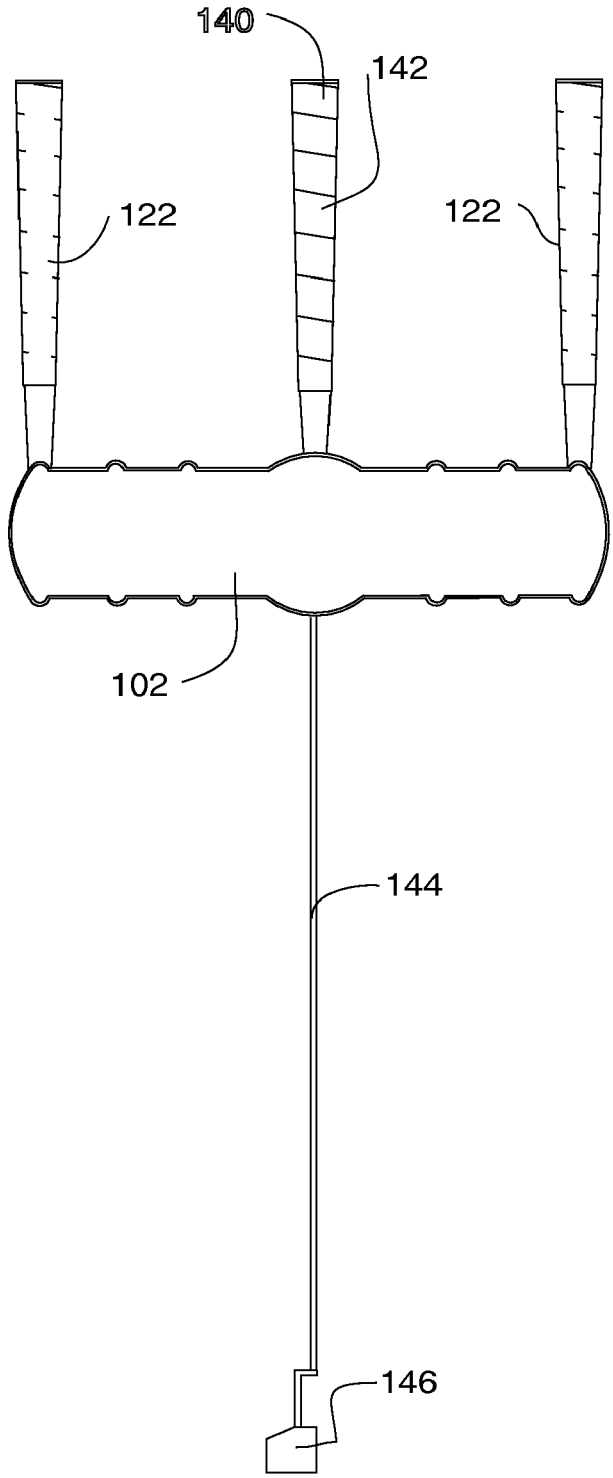
FIG. 8 is a front view of the golf swing adjustable training aid with a putter attached and the training aid grips in the outmost position.
Figure 9:
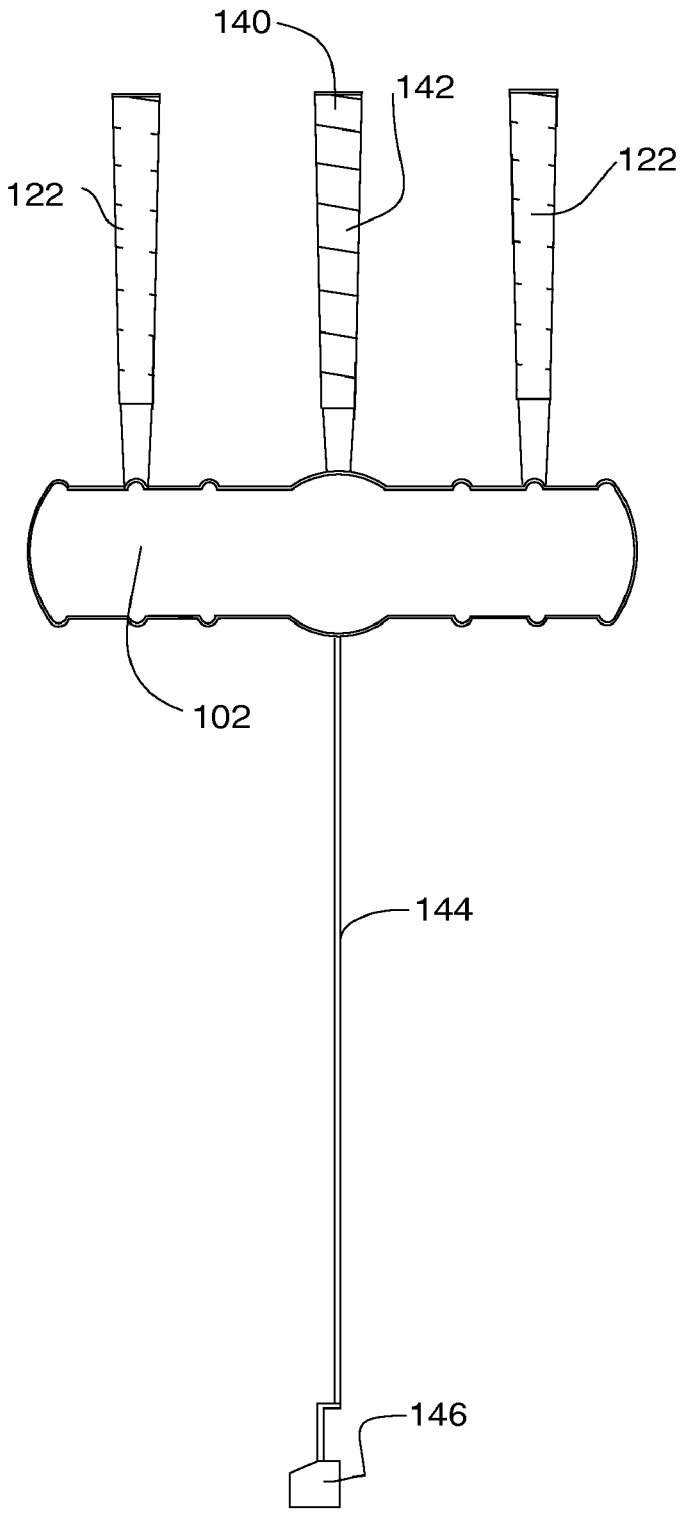
FIG. 9 is a front view of the golf swing adjustable training aid with a putter attached and the training aid grips in the intermediate position.
Figure 10:
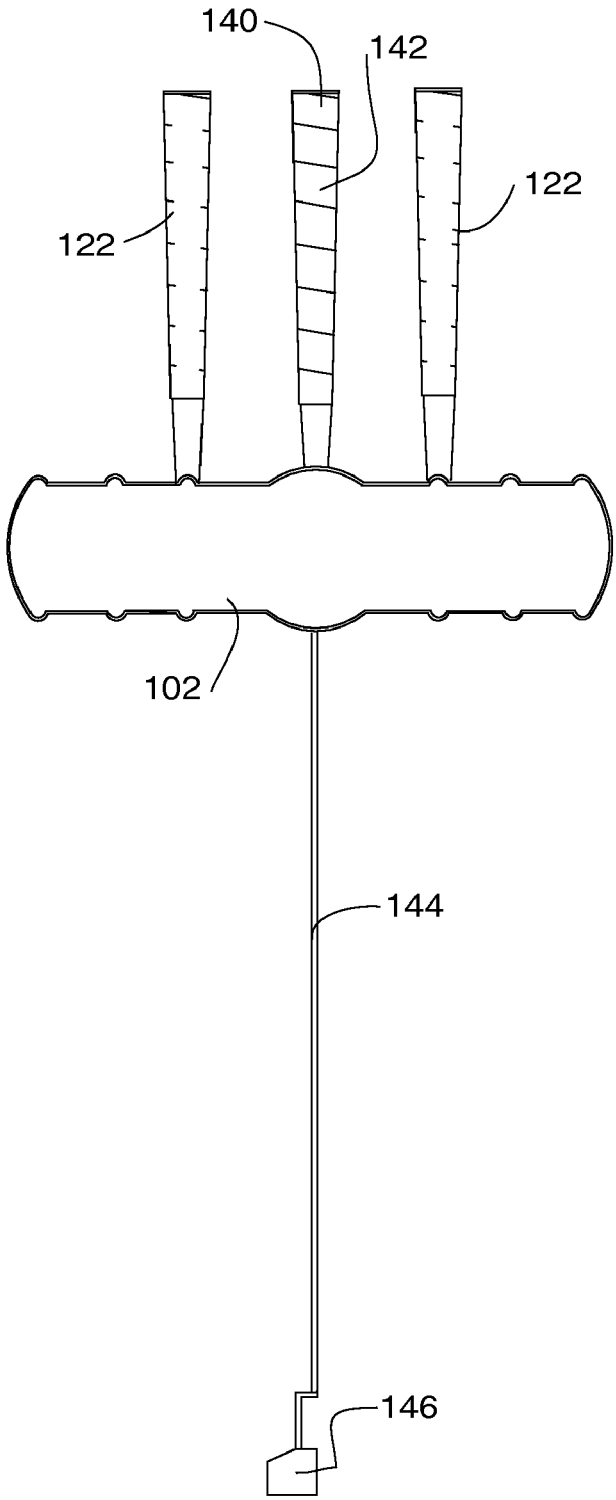
FIG. 10 is a front view of the golf swing adjustable training aid with a putter attached and the training aid grips in the innermost position.

The attachment of the two adjustable golf club grip handles (122) to the frame (102) provides the ability to install the handles on the fame in three symmetrical locations relative to the golf club rest (110). This provides the means for positioning the handles in multiple locations arranged in symmetrical distances from and on each side of, the means for removably attaching a golf club. They can also be attached in non-symmetrical locations, but these are not used for training. These symmetrical locations are shown in FIGS. 8, 9, and 10. The outermost location is shown in FIG. 8, the intermediate location is shown in FIG. 9, and the innermost location is shown in FIG. 10. In these figures a putter (140) with a grip (142), shaft (144), and head (146) is shown attached to the frame (102) and the golf swing adjustable training aid is ready for use.

Operation

The golfer desiring to improve putting performance attaches their putter to the golf swing adjustable training aid by installing the adjustable golf club grip handles (122) on the frame (102) in the outermost position. Then the clamp knob (118) is loosened and the golf club clamp (116) removed. The putter (140) is placed on the resilient insert (114) in the golf club rest (110) with the end of the putter grip (142) aligned at approximately the same distance from the top edge of the frame (102) as the adjustable golf club grip handles (122). The putter head (146) is oriented to be at a right angle to the length of the frame (102). The golf club clamp (116) is then reinstalled and the clamp knob (118) tightened until the putter is securely installed on the frame (102). The golfer is now ready to improve proficiency in controlling the speed and direction of the ball when putting.

Figure 11:
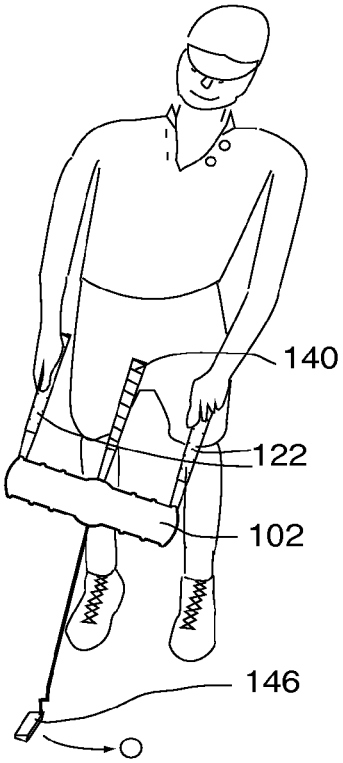
FIG. 11 is a perspective view of the golf swing adjustable training aid illustrating the use of the outermost swing training adjustment.

The golfer positions the golf swing adjustable training aid two adjustable golf club grip handles (122) in the outermost position on the frame (102), equidistant from the attached putter (140), as shown in FIG. 8 and shown in use in FIG. 11. The golfer grasps the training aid handles such that the putter head (146) extends away from the golfer's body. The body is oriented to directly face the ball with the ball approximately centrally located between the feet. Then, using the training aid handles, the arms are moved back and then swung back to have the putter head strike the ball. The golf swing adjustable training aid provides this contact at the point where the length of the frame of the device is parallel to the ground so the putter head is just perpendicular to the ground. This is repeated until the golfer becomes proficient in controlling the speed and direction of the ball.

Figure 12:
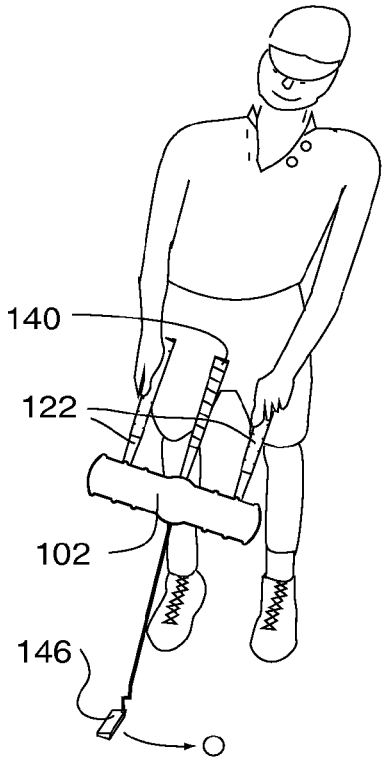
FIG. 12 a perspective view of the golf swing adjustable training aid illustrating the use of the intermediate swing training adjustment.

When proficiency in controlling the speed and direction of the ball improves the golfer repositions the two adjustable golf club grip handles (122) at the intermediate handle position on the frame (102) equidistant from the attached putter (140) as shown in FIG. 9 and shown in use in FIG. 12. The golfer repeats the putting activity as done with the two adjustable golf club grip handles (122) in the outermost position on the frame (102) until the golfer becomes proficient in controlling the speed and direction of the ball.

Figure 13:
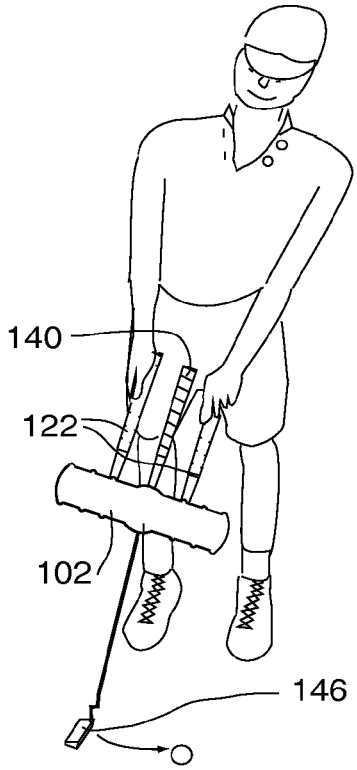
FIG. 13 is a perspective view of the golf swing adjustable training aid illustrating the use of the innermost swing training adjustment.

When proficiency in controlling the speed and direction of the ball improves with the two adjustable golf club grip handles (122) at the intermediate handle position on the frame (102) equidistant from the attached putter (140), the golfer repositions the two adjustable golf club grip handles to the innermost handle position on the frame, equidistant from the attached putter as shown in FIG. 10 and shown in use in FIG. 13. The golfer repeats the putting activity as done with the two adjustable golf club grip handles (122) in the intermediate position on the frame (102) until the golfer becomes proficient in controlling the speed and direction of the ball.

Figure 14:
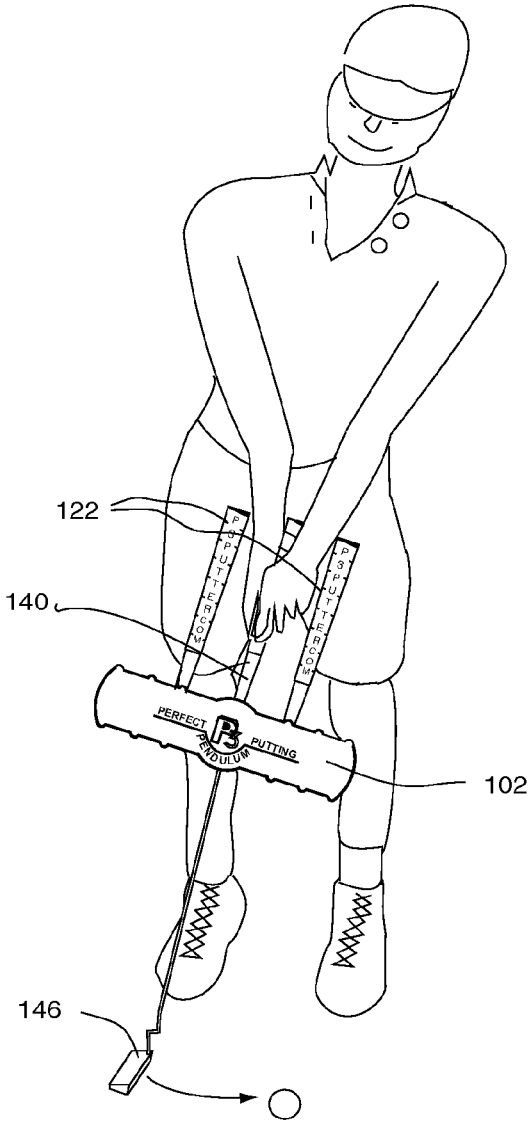
FIG. 14 is a perspective view of the golf swing adjustable training aid illustrating the use of the putter grip with the golf swing adjustable training aid in the outermost swing training adjustment.

When proficiency in controlling the speed and direction of the ball improves the golfer is ready to use the putter grip (142). The golf swing adjustable training aid is still attached to the putter with the two adjustable golf club grip handles (122) in the innermost position on the frame (102), equidistant from the attached putter (140), as shown in FIG. 10 and shown in use in FIG. 14. The golfer repeats the putting activity as done with the two adjustable golf club grip handles (122) in the innermost position on the frame (102) until the golfer becomes proficient in controlling the speed and direction of the ball. The golfer is then prepared to putt without use of the golf swing adjustable training aid, unless, of course, some bad habit is picked up in the course of the golfing career making use of the golf swing adjustable training aid necessary once again.

Figure 15:
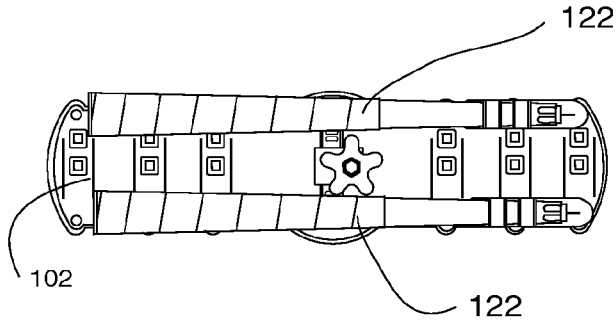
FIG. 15 is a back view of the golf swing adjustable training aid with the handles attached to the frame in a position for transport of the device.

Upon completion of golfing, the golf swing adjustable training aid can be packaged for transport by loosening the clamp knob (118) and then the golf club clamp (116) is removed from its grip on the putter. The putter (140) is removed from the golf club rest (110) and the golf club clamp (116) replaced over the rest and secured by the clamp knob (118). The two adjustable golf club grip handles (122) are disengaged from the frame (102) and reoriented in the long direction of the frame and then attached to two adjacent insert openings (108) magnetic inserts (126), one handle attached to the row of magnetic inserts adjacent to the top edge of the frame and the second handle attached to the row of magnetic inserts adjacent to the bottom edge of the frame. FIG. 15 shows the golf swing adjustable training aid with the handles in such a position, substantially within the edges of the frame (102). This provides means for removably attaching the handles to the frame with the handles arranged substantially within the frame edges. The golf swing adjustable training aid is then compactly packaged and may be placed in a roughly rectangular container or a pocket of a golf bag.

ALTERNATE EMBODIMENTS

The frame construction may be made of alternate materials that may require the features of the frame to be of separate parts. An example includes, but is not limited to this example, a wood frame that may require the handle alignment channels and/or guides, or the golf club rest, to be of separate metal or wood construction and attached to the frame by a fastener, such as a screw or rivet.

The alignment protrusions may differ in arrangement from the use of alignment channels and alignment guides, which will require a corresponding difference in the handle attachment fixture. The possible arrangements are many, and examples of differences may include, but are not limited to, different shapes, sizes, locations, heights, or even orientation, such as placing the alignment protrusions on the handle attachment fixture with corresponding alignment openings in the frame.

The handles may be attached to the handle attachment fixtures in alternate ways. Examples include, but are not limited to, crimping the handle end on a long protrusion of the attachment fixture, crimping a portion of the fixture over the end of the handle, molding the handle in one piece with the attachment fixture, use of fasteners (such as nut and bolt), or threaded attachment.

The attachment fixture may be made of alternate materials that may require the features of the attachment fixture to be of separate parts. An example includes, but is not limited to this example, a wood fixture body that may require the guide opening (128) and handle opening insert (130) to be of separate metal or wood construction and attached to the fixture body by a fastener, such as a screw or rivet.

The handle attachment fixture may be attached to the frame in alternate ways. Examples include, but are not limited to, inserts on one piece, the attachment fixture or frame, that mate with an opening in the other piece and that is sized to provide a resistance fit to join the parts, but is removable.

The number of attachment locations on the frame for the handles may be varied to be less or more to accommodate more or less adjustments or finer or courser adjustments. Those familiar with the art recognize there are many possible applications and variations for the golf swing adjustable training aid than the embodiments recited. This recitation of the preferred and other embodiments is not intended to define or constrain the invention; rather the claims define the invention.

What is claimed is:

1. A body motion training device for use with a golf club comprising:

a. a substantially rigid frame with a first side and a second side, a top edge and a bottom edge and a left edge and a right edge;

b. the frame second side with a centrally located golf club rest arranged to position a golf club shaft with a golf club grip above the frame top edge and the golf club shaft below the frame bottom edge;

c. the frame second side with a threaded opening arranged such that a golf club clamp is positioned on top of the golf club shaft, a clamp knob and a fastener is arranged to engage the threaded opening such that turning the clamp knob and fastener removably retains the golf club shaft between the golf club clamp and the golf club rest;

d. the frame second side with multiple alignment protrusions above the second side surface in each of a multiplicity of locations symmetrically on each side of the golf club rest between the golf club rest and the left and right edges;

e. the frame second side further arranged with a multiplicity of insert openings arranged partially through the frame and located adjacent to the handle attachment alignment channels and handle alignment guides;

f. a multiplicity of magnetic inserts installed in the insert openings;

g. two adjustable handles with a grip end and an attachment end, the attachment end arranged with an attachment opening;

h. two handle attachment fixtures with a first side and a second side, the first side arranged with a handle guide opening and a handle opening insert arranged such that a handle attachment end is inserted into the handle guide opening and the handle opening insert is pressed into the handle opening such that the attachment fixture is removably attached to the handle attachment end;

i. the handle attachment fixture second side arranged with a first edge and a second edge, and one or more alignment openings, the edges and alignment openings arranged to position the attachment fixture by mating with the frame alignment protrusions, and the attachment openings arranged with a magnetic insert retained in the opening and further arranged to magnetically engage the magnetic inserts in the frame insert openings wherein the handle attachment fixture second sides are removably engaged with the frame second side at the desired handle attachment alignment channel and handle alignment guide locations on the frame such that the handles are in the same plane as the golf club grip and are grasped by the golfer to swing the putter.

2. The body motion training device as in claim 1 where the frame alignment protrusions are frame alignment openings and the handle attachment fixture second side alignment edges and openings have alignment protrusions arranged to position the attachment fixture by mating with the frame alignment openings.

3. The body motion training device as in claim 1 where the frame is molded in a single part.

4. The body motion training device as in claim 1 where the frame is made of multiple parts.

5. The body motion training device as in claim 1 where the attachment fixture is made of a single part.

6. The body motion training device as in claim 1 where the attachment fixture is made of multiple parts.

7. The body motion training device as in claim 1 further comprising a resilient insert between the golf club rest and the golf club shaft.

8. The body motion training device as in claim 1 further comprising the handle attachment fixture attachment opening magnetic inserts arranged to magnetically engage the frame insert opening magnetic inserts on either edge of the frame such that one handle is stored for transport adjacent to the frame second side top edge and the second handle is stored for transport adjacent to the frame second side bottom edge.

9. A golfer's training aid using a golf club with a grip, a shaft, and a head comprising:

a. a substantially rigid frame with a top, bottom, left side, and right side edge arranged with means for removably attaching a golf club substantially in the center of the frame such that the club grip is above the frame and the club shaft is below the frame;

b. two substantially straight handles arranged with means to removably attach to the frame;

c. the frame further arranged with means for positioning the handles in multiple locations arranged in symmetrical distances from, and on each side of, the means for removably attaching a golf club, such that the handles are adjustably positioned above the frame top edges in the same plane as the golf club grip, wherein the golfer attaches the handles to the frame in the desired location, then grasps the handles on each side of the golf club grip and swings the frame to use the attached club head to strike a golf ball.

10. The golfer's training aid as in claim 9 further comprising means for removably attaching the handles to the frame with the handles arranged substantially within the frame edges.

11. A method of using a training aid to train a golfer to accurately strike a ball with a putter comprising:

a. attaching two substantially equal length handles to a frame outermost handle positioning means, the handles substantially equidistant from the putter;

b. attaching a putter with a grip to the training aid frame in a central location and arranging the putter on the frame such that the putter grip extends from the frame substantially the same direction and length as the handles;

c. grasping the training aid handles such that the putter head extends away from the golfer's body;

d. using the training aid handles to swing the putter and strike a ball;

e. repeating step d. until the golfer is proficient in controlling the speed and direction of the ball;

f. repositioning the handles at intermediate handle positioning means on the frame substantially equidistant from the attached putter;

g. using the training aid handles to swing the putter and strike a ball;

h. repeating step g. until the golfer is proficient in controlling the speed and direction of the ball;

i. repositioning the handles to the innermost handle positioning means on the frame substantially equidistant from the attached putter;

j. using the training aid handles to swing the putter and strike a ball;

k. repeating step j. until the golfer is proficient in controlling the speed and direction of the ball;

l. using the putter grip to swing the putter and strike a ball;

m. repeating step l. until the golfer is proficient in controlling the speed and direction of the ball.

* * * * *